US006494338B1

(12) United States Patent
Schultz

(10) Patent No.: US 6,494,338 B1
(45) Date of Patent: Dec. 17, 2002

(54) HATCH COVER GASKET

(75) Inventor: Francis R. Schultz, GlenEllyn, IL (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/687,729

(22) Filed: Oct. 12, 2000

(51) Int. Cl.[7] ..... B65D 53/00
(52) U.S. Cl. ..... 220/328; 220/221
(58) Field of Search ..... 220/378, 217, 220/221, 224, 225, 226, 228, 234, 240, 297, 310, 345.6, 803, 804, 806, FOR 205, 352, 795, 314

(56) References Cited

U.S. PATENT DOCUMENTS

| | | | | | |
|---|---|---|---|---|---|
| 3,331,523 | A | * | 7/1967 | Exton | 215/350 |
| 3,696,561 | A | * | 10/1972 | Harp et al. | 49/483 |
| 3,821,935 | A | | 7/1974 | Adler | 105/377 |
| 4,308,956 | A | * | 1/1982 | Dutt | 215/345 |
| 4,331,249 | A | * | 5/1982 | Banich, Jr. | 215/343 |
| 4,428,585 | A | | 1/1984 | Dugge | 277/12 |
| 4,452,150 | A | * | 6/1984 | Dominguez | 105/377 |
| 4,461,219 | A | * | 7/1984 | Bateson | 105/377 |
| 4,768,684 | A | | 9/1988 | Dugge | 222/542 |
| 4,819,930 | A | | 4/1989 | Jackson et al. | 271/209 |
| 4,884,723 | A | | 12/1989 | Dugge | 222/542 |
| 4,944,233 | A | | 7/1990 | Dugge et al. | 105/377 |
| 5,343,609 | A | * | 9/1994 | McNanus | 29/451 |
| 5,355,809 | A | | 10/1994 | Dugge | 105/424 |
| 6,050,199 | A | * | 4/2000 | Andersib et al. | 105/377.07 |

* cited by examiner

*Primary Examiner*—Stephen P. Garbe
*Assistant Examiner*—Lien Ngo
(74) *Attorney, Agent, or Firm*—Baker Botts L.L.P.

(57) ABSTRACT

A hatch cover (10) is engageable with a hatch (11) on a railroad car (13). The hatch cover comprises a first rib (30) and a second rib (32) running annularly about the under side of the hatch cover and has an associated first coefficient of expansion. A gasket (70) having an annular shape and a U-shaped cross-section is coupled to the first and second ribs. The gasket forms a seal between the hatch and the hatch cover. The gasket has a second coefficient of expansion which is greater than the first coefficient of expansion. As the railroad car moves through different external temperature environments, the second coefficient of expansion being greater than the first coefficient of expansion allows the gasket to remain coupled to the hatch cover and maintain the seal between the hatch cover and the hatch throughout the various temperatures experienced.

24 Claims, 5 Drawing Sheets

HATCH COVER GASKET

TECHNICAL FIELD OF THE INVENTION

This invention relates in general to railroad cars and, more particularly, to an apparatus for a hatch cover gasket.

BACKGROUND OF THE INVENTION

Railroad cars are used to transport goods from one location to another. Railroad cars are often loaded with goods through a hatch in the top of the railroad car. A hatch cover is used to cover the hatch. A seal is formed between the hatch cover and the hatch using a hatch cover gasket. Traditional hatch cover gaskets have been coupled to the hatch cover using small tabs or glue to retain the gasket within a channel in the hatch cover.

As railroad cars transport goods from one location to another, the railroad cars often experience numerous temperature changes during the journey. The temperature changes cause the hatch cover gasket to expand and contract. The expansion and contraction of the hatch cover gasket often decouples the hatch cover gasket from the associated hatch cover. Hatch cover gaskets also have a tendency to freeze onto the hatch.

SUMMARY OF THE INVENTION

From the foregoing, it may be appreciated that a need has arisen for a hatch cover gasket capable of remaining coupled to the associated hatch cover when exposed to various temperatures. According to the present invention, a system and apparatus are provided to address the shortcomings of prior hatch cover gaskets.

According to one embodiment of the invention, a hatch cover apparatus comprises a body formed with a first rib and a second rib, the body having a first coefficient of expansion, and a sealing element being annularly shaped and formed with a sealing element body, a first leg, and a second leg. The sealing element is engageable with the body and has a second coefficient of expansion greater than the first coefficient of expansion.

According to another embodiment of the invention, a system comprises a railroad car and a hatch coupled to the railroad car. The system further comprises a hatch cover engage able with the hatch and having a body, a first rib and a second rib coupled thereto, the first and second ribs having a first coefficient of expansion, and a sealing element having an annular shape and having a body, a first leg, and a second leg, the sealing element being engageable with the hatch cover and having a second coefficient of expansion greater than the first coefficient of expansion.

BRIEF DESCRIPTION OF THE DRAWINGS

The present invention is best understood from the detailed description which follows, taken in conjunction with the accompanying drawings, in which.

DETAILED DESCRIPTION OF THE INVENTION

Railroad cars transport goods inside the railroad cars, protecting the goods from damage and external contamination. The railroad cars may experience varying temperature and environmental conditions when transporting the goods. Railroad cars may include a hatch in the top of the railroad car through which goods may be placed in the railroad car. Railroad cars use a hatch cover to cover the hatch in the railroad car. The hatch cover often includes a gasket coupled to the hatch cover for forming a seal between the hatch cover and the hatch. As the railroad car experiences varying temperature and environmental conditions during transport, the gasket may fail due to repeated expansion and contraction caused by the temperature variations experienced by the railroad car. Specifically, the gasket may disconnect from the hatch cover. The disconnection of the gasket from the hatch cover breaks the integrity of the seal between the hatch cover and the hatch. The disconnection of the hatch cover may also allow the gasket to remain in engagement with the hatch after the hatch cover is removed. Removing the gasket from the hatch is time consuming and reattaching a new gasket to the hatch cover is also time consuming and expensive. The present invention involves a hatch cover gasket that remains coupled to the hatch cover and maintains a seal during temperature variations while avoiding attachment to the hatch during hatch cover removal.

Figure 1:
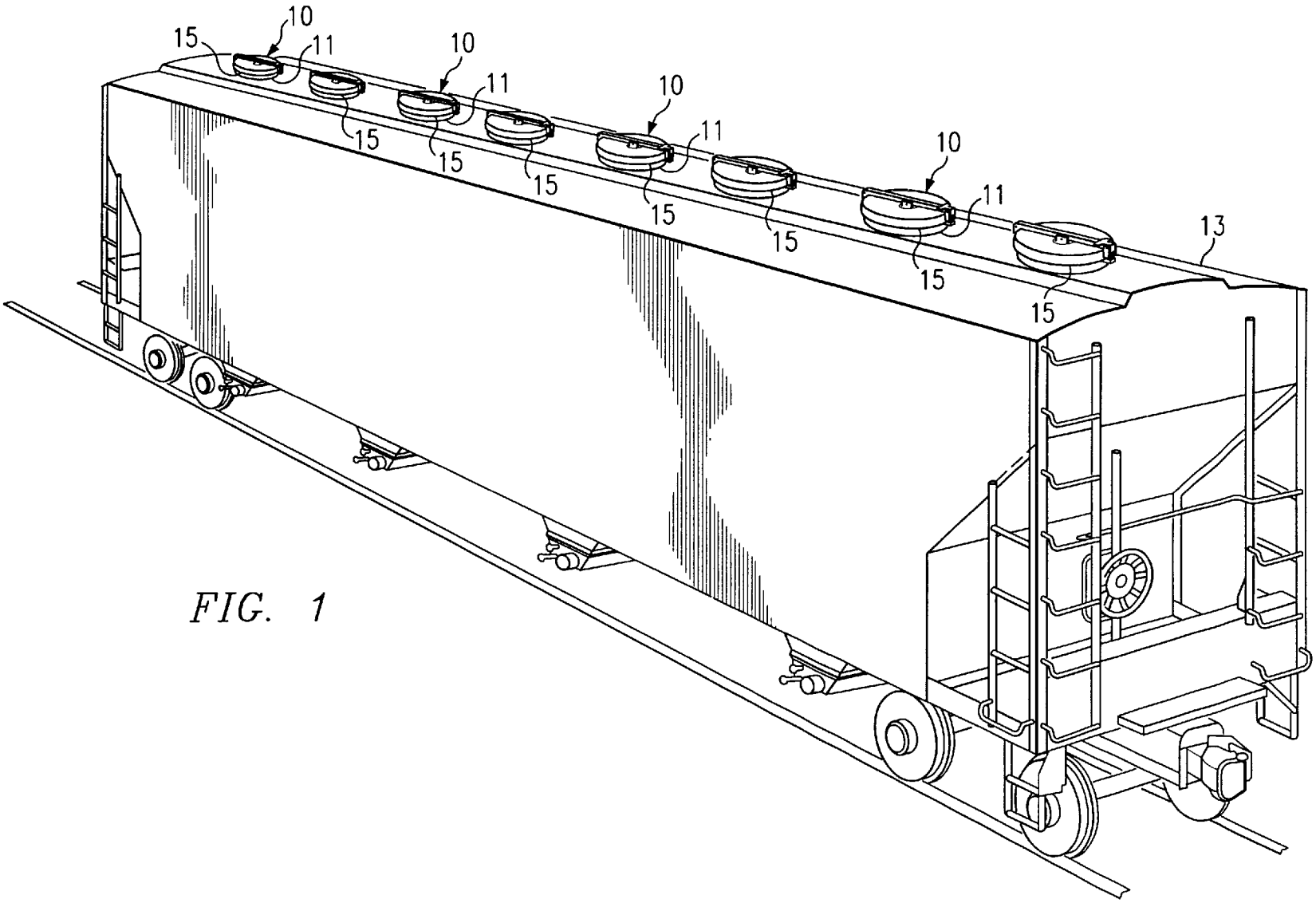
FIG. 1 is a side view of a railroad car having a hatch and a hatch cover.

FIG. 1 is a side view of a railroad car 13 having a hatch 11 covered by a railroad car hatch cover 10. Railroad car 13 may be any suitable railroad car for transporting objects. In the illustrated embodiment, hatch 11 is a generally circular opening through which material may be loaded or unloaded; however, other suitable configurations for hatch 11 may be used, including rectangular and irregularly-shaped hatches. Hatch 11 is formed with a periphery 15 on which hatch cover 10 rests.

According to the teachings of the invention a sealing device 70 (FIG. 7) is oriented between hatch 11 and hatch cover 10 to form a seal. The coefficient of expansion of sealing device 70 is greater than the coefficient of expansion of hatch cover 10, resulting in a better seal in varying temperatures than provided by previous systems and methods.

Figure 2:
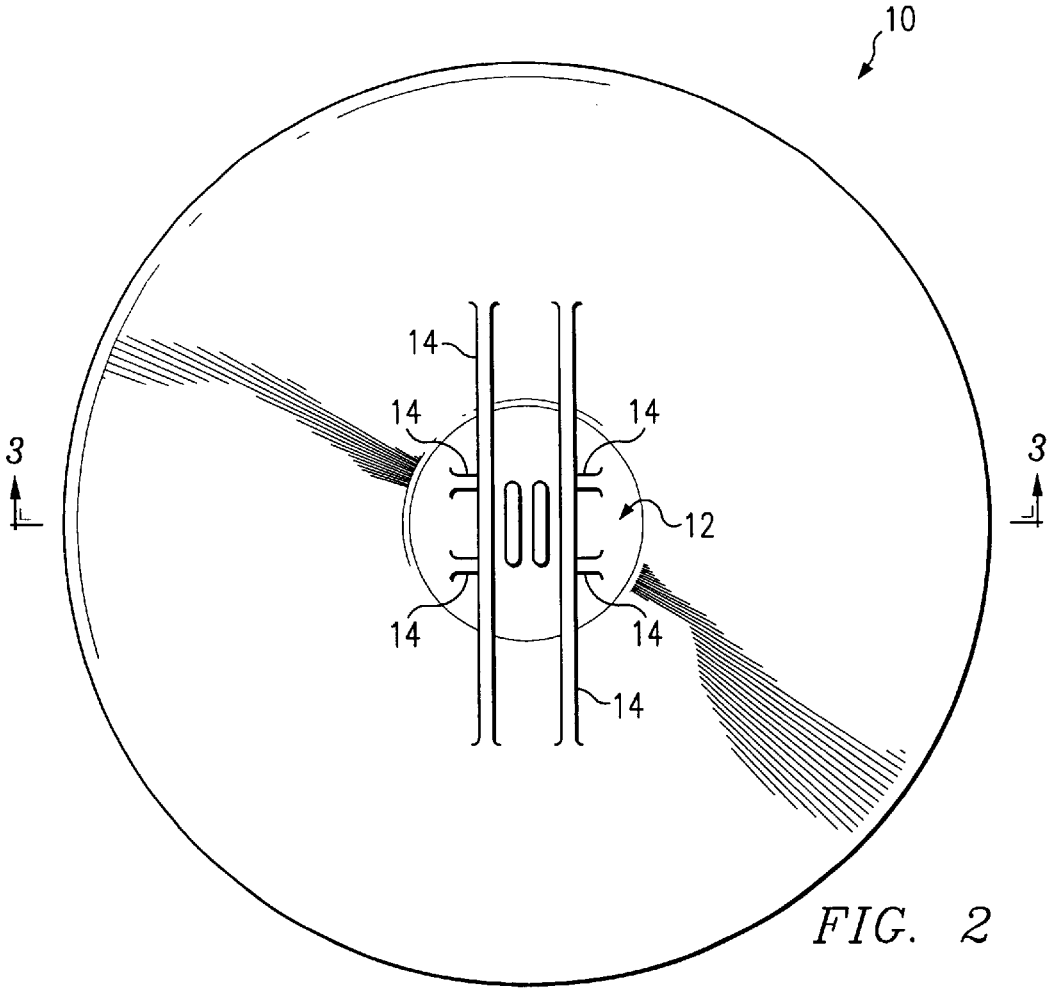
FIG. 2 is a top view of the railroad car hatch cover of FIG. 1.

Additional details of hatch cover 10 are described below in conjunction with FIGS. 2 through 6. Sealing device 70 and its operation are described in conjunction with FIGS. 7 and 8. FIG. 2 is a top view of railroad car hatch cover 10. Hatch cover 10 includes a flat portion 12 formed with a plurality of channels 14. In the illustrated embodiment, hatch cover 10 is a plastic hatch cover; however, hatch cover 10 may be formed from any suitable material. For example, hatch cover 10 may be formed from aluminum or steel.

Figure 3:
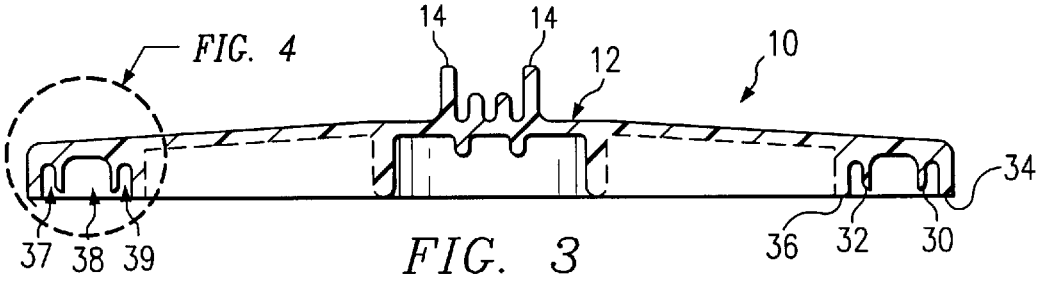
FIG. 3 is a cross-sectional view of the hatch cover along the line 3—3 of FIG. 2.
Figure 4:
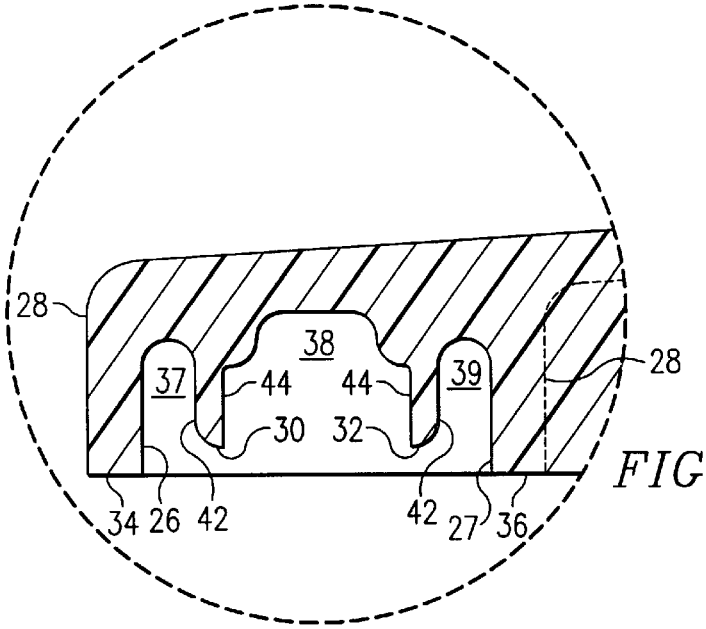
FIG. 4 is a detailed view of a portion of the hatch cover of FIG. 3, showing a plurality of channels, a plurality of ribs, and a plurality of flanges of the hatch cover.

FIG. 3 is a cross-sectional view of hatch cover 10 along the line 3—3 of FIG. 2, and FIG. 4 is a detailed view of indicated portions of FIG. 3. FIGS. 3 and 4 are described together for greater clarity. Hatch cover 10 includes a first flange inner wall 26, a second flange inner wall 27, a flange outer wall 28, a first rib 30, a second rib 32, an outer flange 34, an inner flange 36, an outer channel 37, a center channel 38, an inner channel 39, a rib outer wall 42, and a rib inner wall 44.

Outer flange 34 extends downwardly from an outer edge of hatch cover 10 and extends circumferentially around hatch cover 10. In the illustrated embodiment, inner flange 36 is spaced approximately between three and five inches from outer flange 34 toward the center of hatch cover 10 with inner flange 36 preferably spaced four inches from outer flange 34; however, other suitable spacing may be utilized. Each of the outer and inner flanges 34 and 36 respectively include facing flange inner walls 26 and 27. Outer flange 34 includes flange outer wall 28. Flange outer wall 28 is disposed on the external side of outer flange 34. In the illustrated embodiment, flange inner walls 26 and 27 have less than one degree of deflection toward each other; however, other suitable amounts of deflection toward each other may be tolerated.

Outer channel 37 is formed between first rib 30 and inner wall 26. In the illustrated embodiment, outer channel 37 has a width of one inch or less; however, other suitable widths may be utilized. Outer channel 37 extends around the underside of hatch cover 10 and preferably extends around the entire underside of hatch cover 10.

Center channel 38 is formed by inner wall 44 of first and second ribs 30 and 32. In the illustrated embodiment, center channel 38 is between one and four inches in width and is preferably at least one and one-half inches in width; however, other suitable dimensions may be utilized for center channel 38. Center channel 38 extends around the underside of hatch cover 10 and preferably extends around the entire underside of hatch cover 10.

Inner channel 39 is formed between the outer wall of the second rib 32 and inner wall 26 of inner flange 36. In the illustrated embodiment, inner channel 39 is up to one inch in width; however, other widths may be used in other embodiments. Inner channel 39 extends around the underside of hatch cover 10 and preferably extends around the entire underside of hatch cover 10.

Ribs 30 and 32 extend annularly around the underside of hatch cover 10. Ribs 30 and 32 may alternatively extend around the underside of hatch cover 10 in a manner such that the ribs 30 and 32 are continuous or non-continuous. Ribs 30 and 32 are formed from the same material as hatch cover 10. Ribs 30 and 32 run generally parallel to each other and to outer flange 34. Ribs 30 and 32 are tapered such that they decrease in thickness from bottom to top. In particular, a respective base portion of ribs 30 and 32 is coupled to the underside of hatch cover 10. The respective base portions are thicker than an upper portion of ribs 30 and 32. Ribs 30 and 32 each have respective facing inner walls 44 with up to two degrees of deflection. The ribs may be between 0.040 and 0.312 of an inch in width and in the illustrated embodiment are between 0.090 and 0.095 of an inch. In the illustrated embodiment, ribs 30 and 32 are spaced approximately 1.5 inches apart from each other, and are spaced approximately 1 inch from outer flange 34 and inner flange 36; however, other suitable spacing may be used.

In the illustrated embodiment, ribs 30 and 32 are flexible in order to respond to changes in temperature as described in more detail below in association with FIGS. 7–9.

Figure 6:
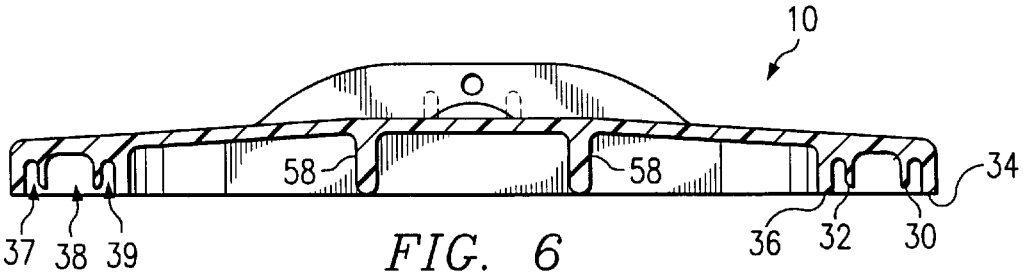
FIG. 6 is a cross-sectional view of the underside of the hatch cover along the line 6—6 of FIG. 5.
Figure 5:
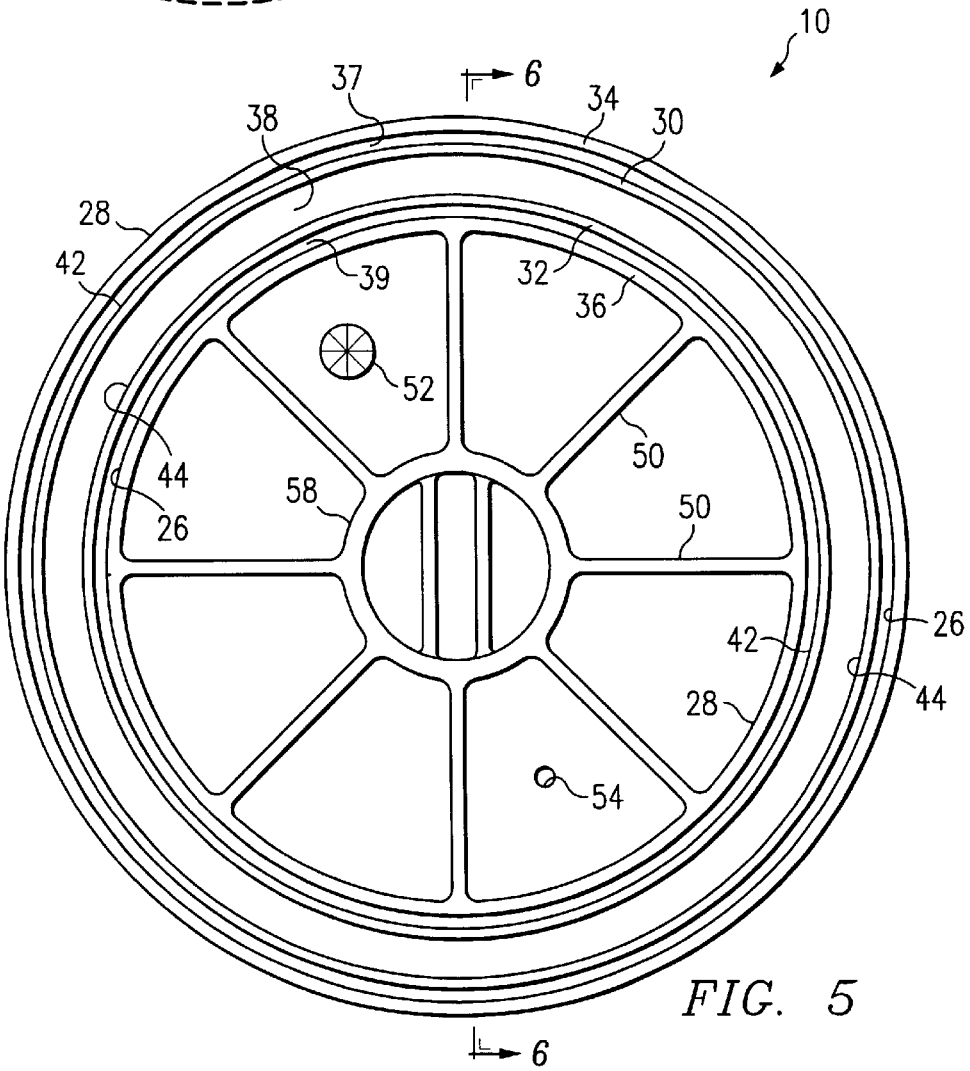
FIG. 5 is a top view of the underside of the hatch cover of FIG. 1.

FIG. 5 is a top view of the underside of the hatch cover of FIG. 1, and FIG. 6 shows a cross-sectional view of the underside of the hatch cover along lines 6—6 of FIG. 5. FIGS. 5 and 6 are described together for increased clarity. Hatch cover 10 further includes a plurality of reinforcing members 50, a date wheel 52, and a hub 58. Reinforcing members 50 are disposed approximately 45° from each other, but any suitable angle may be used, and are coupled at a first end to inner flange 36 and at a second end to hub 58. In the disclosed embodiment, reinforcing members 50, inner flange 36, and hub 58 are formed integral with each other. Reinforcing members 50 provide structural reinforcement and support to hatch cover 10. Date wheel 52 may be used to provide an indication of the day and date of when hatch cover 10 was molded.

Figure 7:
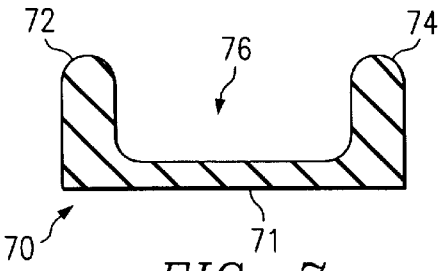
FIG. 7 is a side view of a gasket for use with the hatch cover according to the present invention.
Figure 7A:
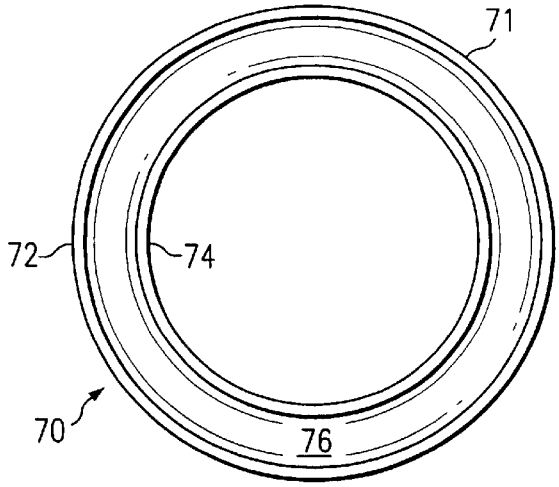
FIG. 7A is a top view of the gasket of FIG. 7.

FIG. 7 is a side view of a gasket 70 for use in forming a seal between hatch cover 10 and hatch 11, according to the present invention. FIG. 7A is a top view of gasket 70. FIGS. 7 and 7A are discussed together for increased clarity. According to the illustrated embodiment, gasket 70 is made from FDA vinyl 45 to 60 durometer-shore A; however, other suitable materials may be used, including 45–65 durometer-shore A Santaprene. Gasket 70 has a coefficient of expansion that relates how much gasket 70 expands with increasing temperature that is larger than the coefficient of expansion of hatch cover 10. Gasket 70 may be formed from any suitable flexible plastic, such as polyvinyl chloride, such that the material used to form gasket 70 has a greater coefficient of expansion than the material used to form hatch cover 10. In particular, advantageous relationships between the coefficient of expansion of gasket 70 is greater than one and less than or equal to twenty times greater than the coefficient of expansion of the hatch cover 10. Moreover, the coefficient of expansion of gasket 70 is preferably five times greater than the coefficient of expansion of hatch cover 10. Gasket 70 is operable to remain coupled to hatch cover 10 and sealably engaged with hatch 11 at temperatures between −40 degrees Fahrenheit and plus 140 degrees Fahrenheit, inclusive.

Gasket 70 includes a body 71, a first leg 72, a second leg 74, and a channel 76. Gasket 70 is annularly shaped and has a U-shaped cross-section. Body 71 is the long portion of the U-shaped cross-section of gasket 70 and a bottom surface of body 71 is engage able with hatch 11 to form a seal between hatch cover 10 and hatch 11 as shown in FIG. 8.

Figure 9:
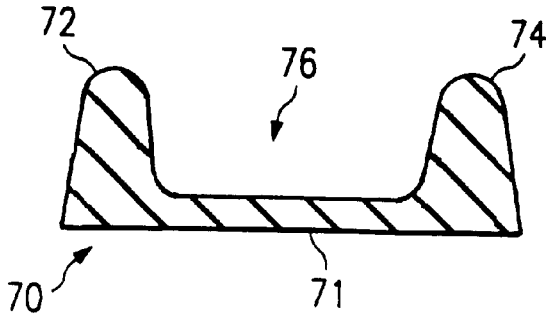
FIG. 9 is a side view of a gasket with tapered legs according to an embodiment of the present invention.
Figure 10:
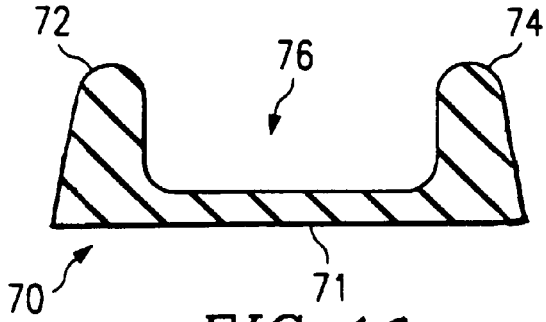
FIG. 10 is a side view of a gasket with legs having tapered outer walls according to an embodiment of the present invention.
Figure 11:
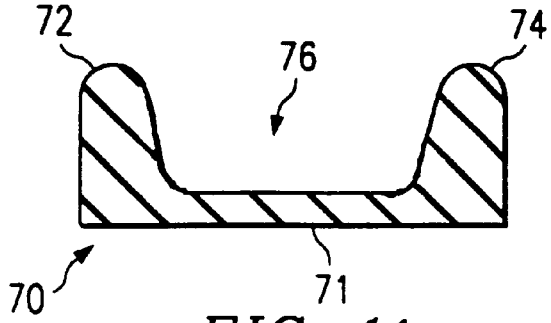
FIG. 11 is a side view of a gasket with legs having tapered inner walls according to an embodiment of the present invention.

As shown in FIG. 9, legs 72 and 74 may be tapered. As shown in FIG. 10, legs 72 and 74 may have outer walls which are tapered, and inner walls which remain unhampered. As shown in FIG. 11, legs 72 and 74 may have inner walls which are tapered and out walls which remain unhampered.

Legs 72 and 74 are coupled to body 71. In the illustrated embodiment, legs 72 and 74 are press fit to body 71. Legs 72 and 74 may be tapered. Channel 76 is generally U-shaped and is formed by body 71, and legs 72 and 74. As shown in FIG. 8, channel 76 interacts with ribs 30 and 32, and legs 72 and 74 are respectively disposed within channels 37 and 39 to engage gasket 70 with hatch cover 10.

Figure 7B:
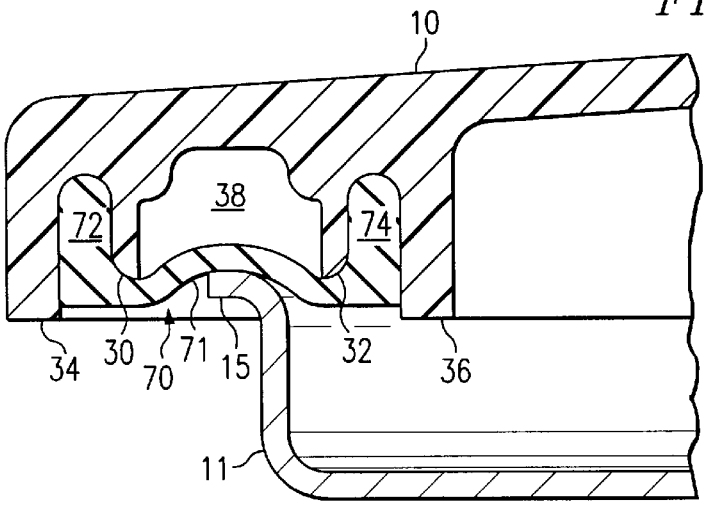
FIG. 7B illustrates the hatch cover engaged with the hatch of FIG. 1.

FIG. 7B illustrates hatch cover 10 engaged with hatch 11. As hatch cover 10 is engaged with hatch 11, periphery 15 of hatch 11 engages with body 71 and the lip portion presses upwardly on body 71 and forces body 71 into center channel 38. When hatch cover 10 is in sealing engagement with hatch 11, periphery 15 extends partially into center channel 38. The flexibility of gasket 70 allows body 71 to form a seal between periphery 15 and hatch cover 10. As body 71 is forced into center channel 38, legs 72 and 74 are pulled inwardly toward center channel 38 by body 71 and are forced to tightly grip respective ribs 30 and 32.

Figure 8:
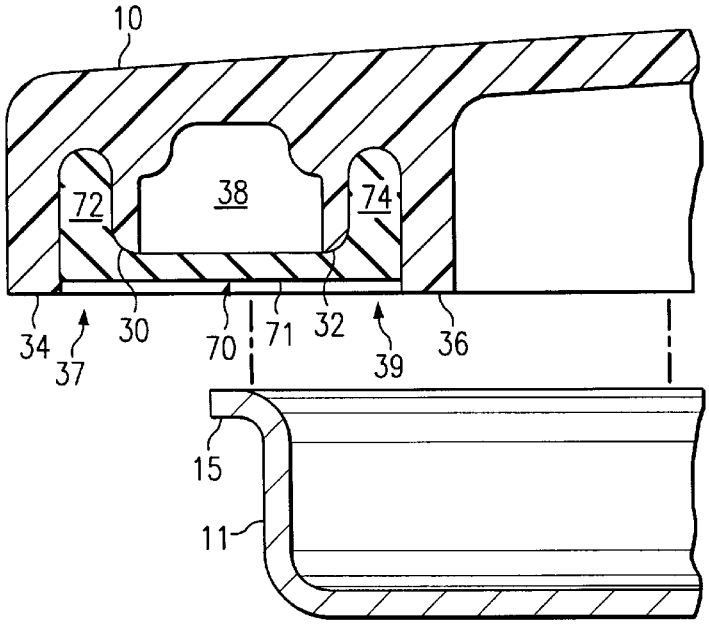
FIG. 8 is a cross-sectional view of the gasket of FIG. 7 coupled to the hatch cover of FIG. 1.

FIG. 8 is a cross-sectional view of the gasket. Gasket 70 is press-fit onto ribs 30 and 32 such that ribs 30 and 32 are engaged with the inner walls of legs 72 and 74. Gasket 70 is maintained in engagement with ribs 30 and 32 by friction and pressure between ribs 30 and 32 and legs 72 and 74. At standard temperature, gasket 70 is in a rest state where legs 72 and 74 grip ribs 30 and 32 such that friction and pressure prevent gasket 70 from disengaging from ribs 30 and 32. Ribs 30 and 32 are flexible and bend sufficiently to allow gasket 70 to firmly grip ribs 30 and 32 in the rest state. For example, ribs 30 and 32 may be formed from polyvinyl chloride or Santaprene.

Gasket 70 has a greater coefficient of expansion that the material used for ribs 30 and 32. The greater coefficient of expansion of gasket 70 allows gasket 70 to remain coupled to hatch cover 10 during temperature changes. For example, in cold temperatures, hatch cover 10 will contract less than gasket 70 causing gasket 70 to press harder on the ribs 30 and 32 because gasket 70 will have contracted more than hatch cover 10. In hot temperatures, hatch cover 10 will expand to a lesser extent than gasket 70 causing gasket 70 to press against inner walls 26 of flanges 34 and 36 because gasket 70 will have expanded to a greater extent than hatch cover 10.

The present invention provides a number of technical advantages. One such technical advantage is the capability of the gasket to remain coupled to the hatch cover under various temperature conditions. The gasket is capable of maintaining a seal between the hatch cover and the hatch because the gasket does not freeze onto the hatch and does not decouple from the hatch cover. Thus, the gasket according to the present invention disengages from the hatch when the hatch cover is removed and avoids the need to remove the gasket from the hatch as is often necessary with traditional gaskets. Another advantage is that the gasket is press-fit onto the hatch cover, thus avoiding the need to glue the gasket to the hatch cover.

It should also be recognized that direct connections disclosed herein can be altered, such that two disclosed components or elements would be coupled to one another through an intermediate device or devices without being directly connected, while still realizing the present invention. Other changes, substitutions, and alterations are also possible without departing from the spirit and scope of the present invention, as defined by the following claims.

What is claimed is:

1. A hatch cover apparatus comprising:

a hatch cover body formed with a first channel at least partially defined by a first rib, a second channel at least partially defined by a second rib, and a center channel disposed between the first and second ribs, the body having a first coefficient of expansion;

a sealing element being annularly shaped and formed with a sealing element body, a first leg disposed within the first channel, and a second leg disposed within the second channel, the sealing element having a second coefficient of expansion greater than the first coefficient of expansion, wherein engagement of the hatch cover with a hatch operates to move a portion of the sealing element body from a first position external to the center channel to a second position at least partially disposed within the center channel, and wherein the center channel is substantially devoid of the sealing element in the first position.

2. The hatch cover of claim 1, wherein the hatch cover body further comprises an outer edge and an inner edge, the first channel being disposed between the outer edge and the first rib, and the second channel being disposed between the inner edge and the second rib, wherein the sealing element has a generally U-shaped cross-section and wherein the first leg is engageable with the outer edge and the first rib, and the second leg is engageable with the second rib and the inner edge.

3. The hatch cover of claim 2, wherein the sealing element is press-fit into engagement with the hatch cover body such that the first leg is disposed within the first channel and the second leg is disposed within the second channel.

4. The hatch cover of claim 1, wherein the first leg comprises a first inner wall and a first outer wall, and the second leg comprises a second inner wall and a second outer wall, the first and second outer walls being tapered and the first and second inner walls being unhampered.

5. The hatch cover of claim 2, wherein the first, second and center channels, and the first and second ribs extend continuously about the underside of the hatch cover.

6. The hatch cover of claim 1, wherein the ribs have a width from 0.040 inches to 0.156 inches, inclusive.

7. The hatch cover of claim 1, wherein the ribs have a width in the range of 0.090 inches to 0.312 inches, inclusive.

8. The hatch cover of claim 1, wherein the second coefficient of expansion is greater than one and is less than or equal to twenty times the magnitude of the first coefficient of expansion.

9. The hatch cover of claim 1, wherein the second coefficient of expansion is approximately three to five times the magnitude of the first coefficient of expansion.

10. The hatch cover of claim 1, wherein the sealing element is made from Polyvinyl chloride 60 durometer shore A.

11. The hatch cover of claim 1, wherein the sealing element is made from Polyvinyl chloride of between 45–60 Durometer shore A, inclusive.

12. A system comprising:

a railroad car;

a hatch coupled to the railroad car;

a hatch cover engageable with the hatch and having a hatch cover body, a first rib and a second rib coupled thereto, the first and second ribs having a first coefficient of expansion, the hatch cover body including a first channel at least partially defined by the first rib, a second channel at least partially defined by the second rib and a center channel defined by the first and second ribs; and a sealing element having an annular shape and having a sealing element body, a first leg disposed within the first channel, and a second leg disposed within the second channel, the sealing element being engageable with the hatch cover and having a second coefficient of expansion wherein engagement of the hatch cover with the hatch operates to move a portion of the sealing element body from a first position external to the center channel to a second position at least partially disposed within the center channel; and wherein the center channels is substantially devoid of the sealing element in the first position greater than the first coefficient of expansion.

13. The system of claim 12, wherein the first, second and center channels are disposed within a hatch cover channel extending around the underside of the body and having an outer edge and an inner edge, wherein the first and second ribs are disposed within the hatch cover channel, and wherein the first channel is disposed between the outer edge and the first rib, the center channel is disposed between the first rib and the second rib, and the second channel is disposed between the second rib and the inner edge.

14. The hatch cover of claim 13, wherein the first leg is engageable with the outer edge and the first rib, and the second leg is engageable with the second rib and the inner edge, wherein the first leg is disposed in the first channel and the second leg is disposed in the second channel, wherein engagement of the hatch cover with a hatch operates to move a portion of the sealing element body from a first position external to the center channel to a second position at least partially disposed within the center channel, and wherein the center channel is substantially devoid of the sealing element in the first position.

15. The hatch cover of claim 12, wherein the second coefficient of expansion greater than 1 and is less than or equal to 20 times the magnitude of the first coefficient of expansion.

16. A railway car hatch cover apparatus comprising:

a hatch cover body formed with a first channel, a second channel, and a center channel; and a sealing element being annularly shaped and formed with a sealing element body, a first leg disposed within the first channel, and a second leg disposed within the second channel;

wherein engagement of the hatch cover apparatus with a hatch operates to move a portion of the sealing element body from a first position external to the center channel to a second position at least partially disposed within the center channel; and wherein the center channel is substantially devoid of the sealing element in the first position.

17. The railway car hatch cover of claim 16, wherein the hatch cover body further comprises a first rib and a second rib, and wherein the first channel is at least partially defined by the first rib, the second channel is at least partially defined by the second rib, and the center channel is disposed between the first and second ribs.

18. The railway car hatch cover of claim 16, wherein the first and second legs are tapered.

19. A railway car hatch cover apparatus comprising:

a hatch cover body formed with a first channel, a second channel, and a center channel; and a sealing element being annularly shaped and formed with a sealing element body, a first leg disposed within the first channel, and a second leg disposed within the second channel, wherein the first and second legs are substantially parallel with each other;

wherein engagement of the hatch cover apparatus with a hatch operates to move a portion of the sealing element body from a first position external to the center channel to a second position at least partially disposed within the center channel; and wherein the center channel is substantially devoid of the sealing element in the first position.

20. The railway car hatch cover of claim 19, wherein the body further comprises a first rib and a second rib, and wherein the first channel is at least partially defined by the first rib, the second channel is at least partially defined by the second rib, and the center channel is disposed between the first and second ribs.

21. The railway car hatch cover of claim 19, wherein the first and second legs are tapered.

22. A railway car hatch cover apparatus comprising:

a hatch cover body formed with a first channel, a second channel, and a center channel; and a sealing element being annularly shaped and formed with a sealing element body and exactly two legs, one of the legs being disposed within the first channel and the other leg being disposed within the second channel;

wherein engagement of the hatch cover apparatus with a hatch operates to move a portion of the sealing element body from a first position external to the center channel to a second position at least partially disposed within the center channel; and wherein the center channel is substantially devoid of the sealing element in the first position.

23. The railway car hatch cover of claim 22, wherein the body further comprises a first rib and a second rib, and wherein the first channel is at least partially defined by the first rib, the second channel is at least partially defined by the second rib, and the center channel is disposed between the first and second ribs.

24. The railway car hatch cover of claim 22, wherein the first and second legs are tapered.

* * * * *